US005524542A

United States Patent [19]

Toyama

[11] Patent Number: 5,524,542

[45] Date of Patent: Jun. 11, 1996

[54] METHOD AND APPARATUS FOR CONTROLLING INK SUPPLY AMOUNT FOR PRINTING PRESS

[75] Inventor: Katsuki Toyama, Ibaragi, Japan

[73] Assignee: Komori Corporation, Tokyo, Japan

[21] Appl. No.: 386,681

[22] Filed: Feb. 10, 1995

[30] Foreign Application Priority Data

Feb. 17, 1994 [JP] Japan ..... 6-041767

[51] Int. Cl.[6] ..... B41F 31/04

[52] U.S. Cl. ..... 101/485; 101/365

[58] Field of Search ..... 101/365, 350, 101/363, DIG. 45, DIG. 47, 366, 351, 352, 484, 485

[56] References Cited

U.S. PATENT DOCUMENTS 5,170,711 12/1992 Maier et al. ..... 101/368

FOREIGN PATENT DOCUMENTS 0095649 5/1983 European Pat. Off. .
58-201008 11/1983 Japan .

*Primary Examiner*—J. Reed Fisher
*Attorney, Agent, or Firm*—Blakely, Sokoloff, Taylor & Zafman

[57] ABSTRACT

In a method of controlling an ink supply amount for a printing press, values corresponding to image areas of a plurality of zones obtained by dividing a plate surface are read out as initial values. Correction amounts are obtained on the basis of the readout initial values and a current printing speed. The initial values are corrected using the obtained correction amounts to obtain correction values. Opening degrees of a plurality of ink fountain keys for adjusting ink supply amounts of the zones are controlled on the basis of the obtained correction values. An apparatus for controlling an ink supply amount is also disclosed.

5 Claims, 3 Drawing Sheets

METHOD AND APPARATUS FOR CONTROLLING INK SUPPLY AMOUNT FOR PRINTING PRESS

BACKGROUND OF THE INVENTION

The present invention relates to a method and apparatus for controlling an ink supply amount for a printing press.

As a conventional method of controlling an ink supply amount of this type, image areas of a plurality of zones obtained by dividing a plate surface are measured, and the image areas of each zone of the plate surface are averaged to obtain an average image area. A rotational speed Ts of an ink fountain roller is determined in accordance with the resultant average image area, and opening degrees $S_{01}$ to $S_{0n}$ of ink fountain keys of the respective zones are obtained on the basis of the image areas of the respective zones. An ink supply amount is controlled on the basis of the resultant rotational speed Ts and the opening degrees $S_{01}$ to $S_{0n}$ as initial values.

In the conventional method of controlling an ink supply amount described above, the rotational speed Ts of the ink fountain roller or the like is changed to adjust (color registration) an ink density so as to match a rotational frequency (printing speed) $V_x$ for the printing press. However, it is difficult to maintain a predetermined density according to this method because the rotational speed Ts of the ink fountain roller increases with an increase in printing speed $V_x$.

This may be caused by various factors such as expansion of the ink fountain roller by ink stirring heat and a decrease in contact area of an ink feed roller by a jump during damping. In addition to these factors, at a portion where the opening degree of the ink fountain key is small, a flow resistance increases at a gap between the ink fountain key and the ink fountain roller with an increase in rotational speed Ts of the ink fountain roller. It is difficult to properly supply an ink at this portion. As a result, in a rotary printing press, when the rotational speed Ts of the ink fountain roller increases, the ink density is excessively increased at a portion where the opening degree of the ink fountain key is large. To the contrary, the ink density is excessively decreased at a portion where the opening degree of the ink fountain key is small, resulting in inconvenience.

When the rotational speed Ts of the ink fountain roller is changed to adjust the ink density, a color registration time is undesirably prolonged, and the number of waste paper sheets disadvantageously increases. When the movement of the ink feed roller and the speed of the ink fountain roller increase, the durability of mechanical components is degraded, and electrical components are overloaded.

SUMMARY OF THE INVENTION

It is an object of the present invention to provide a method and apparatus for controlling an ink supply amount, capable of stabilizing a printing density even if a printing speed increases.

It is another object of the present invention to provide a method and apparatus for controlling an ink supply amount, which can prevent increases in the number of waste paper sheets and a color registration time prolonged with a change in rotational speed of an ink fountain roller.

It is still another object of the present invention to provide a method and apparatus for controlling an ink supply amount, which is free from degradation of the durability of mechanical components and overload of electrical components.

In order to achieve the above objects of the present invention, there is provided a method of controlling an ink supply amount for a printing press, comprising the steps of reading out, as initial values, values corresponding to image areas of a plurality of zones obtained by dividing a plate surface, obtaining correction amounts on the basis of the readout initial values and a current printing speed, correcting the initial values using the obtained correction amounts to obtain correction values, and, on the basis of the obtained correction values, controlling opening degrees of a plurality of ink fountain keys for adjusting ink supply amounts of the zones.

DESCRIPTION OF THE PREFERRED EMBODIMENT

Figure 2:
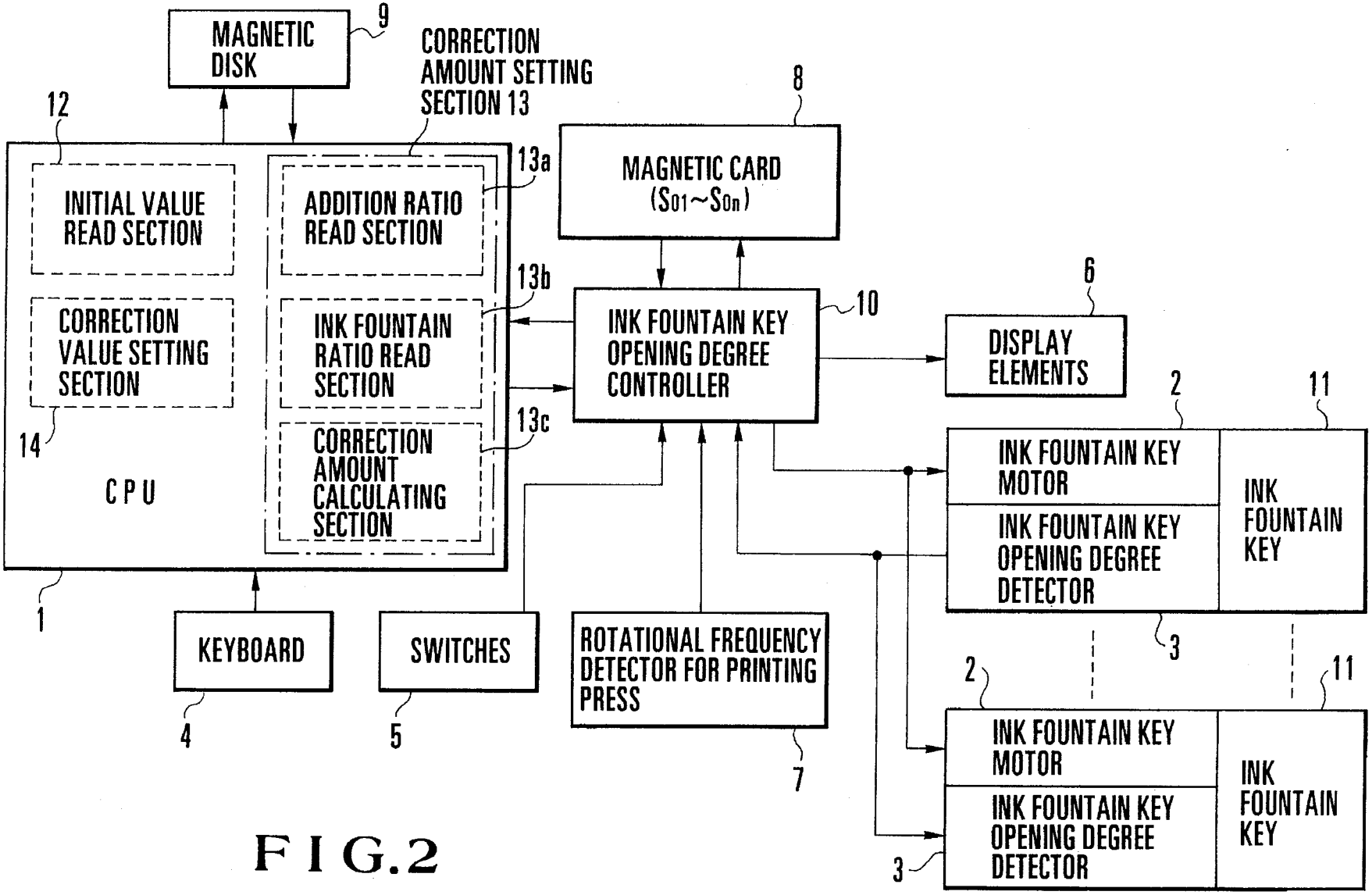
FIG. 2 is a block diagram showing the ink supply amount control apparatus according to an embodiment of the present invention.

The preferred embodiment of the present invention will be described in detail below. FIG. 2 shows an ink supply amount control apparatus to which the present invention is applied. Referring to FIG. 2, reference numeral 1 denotes a CPU (Central Processing Unit) for controlling overall ink supply; 2, a plurality of ink fountain key motors, respectively, arranged in correspondence with a plurality of ink fountain keys 11, for independently opening/closing the ink fountain keys 11; 3, a plurality of ink fountain key opening degree detectors, respectively, arranged in correspondence with the ink fountain keys 11, for detecting the opening degrees of the ink fountain keys 11; 4, a keyboard for inputting various data including change pattern information; 5, switches including a switch for allowing an operator to manually adjust the opening degree of each ink fountain key 11 and switches for respectively selecting paper quality and the kind of ink; 6, display elements for respectively displaying the current opening degree of each ink fountain key 11 and an ON/OFF state of the printing press; 7, a rotational frequency detector for a printing press, for detecting a speed (printing speed) $V_x$ of the printing press; 8, a magnetic card for storing initial values of the opening degrees of the ink fountain keys 11; 9, a magnetic disk for storing first and second characteristic tables each having a plurality of patterns corresponding to paper quality and the kind of ink; and 10, an ink fountain key opening degree controller for controlling the opening degrees of the ink fountain keys 11 in accordance with an instruction from the CPU 1.

The ink fountain keys 11 are respectively arranged in n zones obtained by axially dividing the surface of a plate cylinder to adjust ink supply amounts of the respective zones. The opening degree of each ink fountain key 11 is in proportion to an ink supply amount. The CPU 1 comprises an initial value read section 12 for reading out an initial value from the magnetic card 8, a correction amount setting section 13 for calculating a correction amount on the basis of the initial value and the current printing speed from the rotational frequency detector 7, and a correction value setting section 14 for setting a correction value from the resultant correction amount. The correction amount setting section 13 comprises an addition ratio read section 13*a* for reading out an addition ratio from the second characteristic table, an ink fountain ratio read section 13*b* for reading out an ink fountain key ratio setting value from the first characteristic table, and a correction amount calculating section 13*c* for calculating the correction amount on the basis of the readout addition ratio and the readout ink fountain key ratio setting value.

Figure 1:
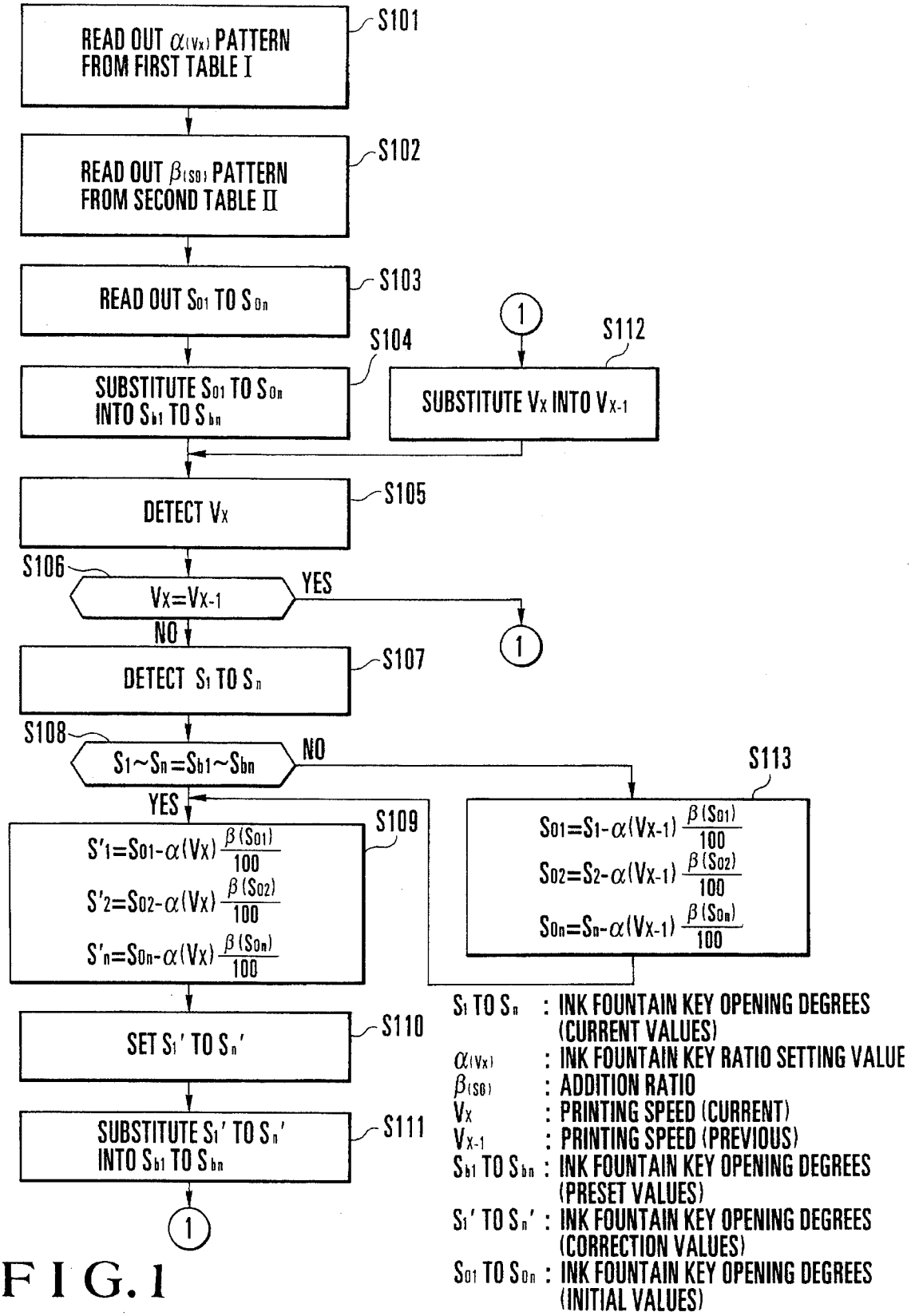
FIG. 1 is a flow chart showing processing operations of an ink supply amount control apparatus shown in FIG. 2.
Figure 3:
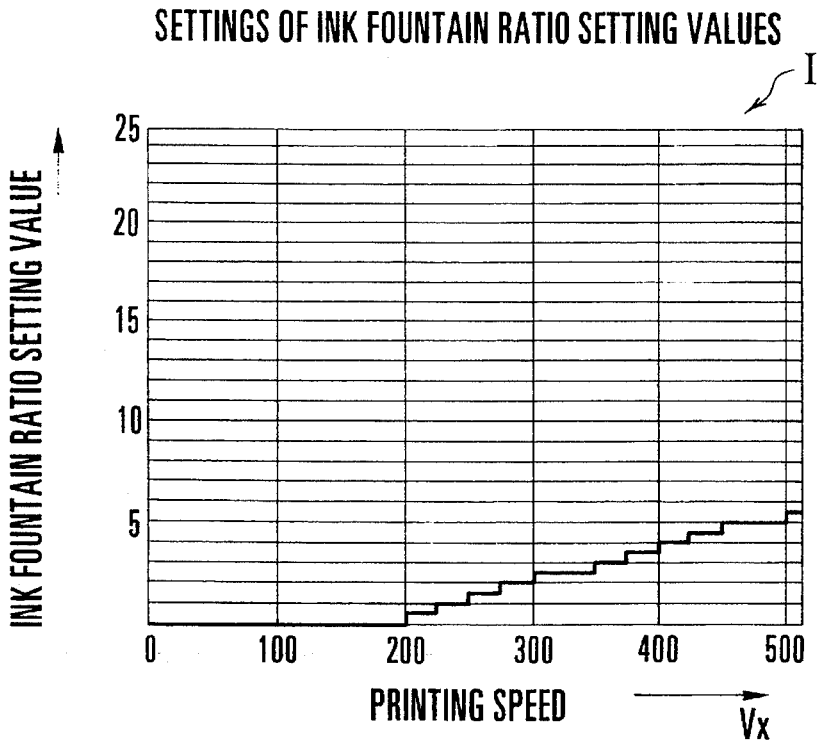
FIG. 3 is the first table showing a relationship between a printing speed $V_x$ and an ink fountain key ratio setting value $\alpha$.
Figure 4:
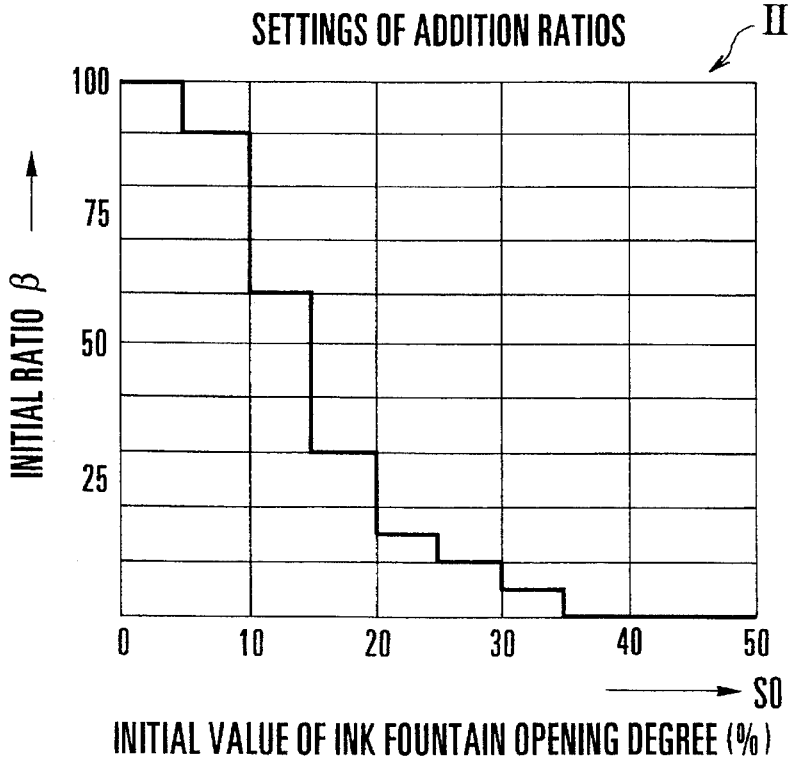
FIG. 4 is the second table showing a relationship between the opening degree $S_0$ of an ink fountain key and an addition ratio $\beta$.

An operation of the ink supply amount control apparatus having the above arrangement will be described with reference to a flow chart in FIG. 1. First of all, the CPU 1 reads out, from the magnetic disk 9, a first characteristic table (FIG. 3) I representing the relationship between the printing speed $V_x$ and an ink fountain key ratio setting value $\alpha$ and a second characteristic table (FIG. 4) II representing the relationship between an opening degree (initial value) $S_0$ of each ink fountain key 11 and an addition ratio $\beta$ (steps S101 and 102). In this case, an $\alpha_{(Vx)}$ pattern and a $\beta_{(S0)}$ pattern, which correspond to the paper quality of the kind of ink set by the switches 5, are read out from the first and second characteristic tables I and II preset in the magnetic disk 9. Note that the patterns constituting the first and second characteristic tables can be changed at the keyboard 4, and the changed patterns are reset in the magnetic disk 9.

The initial value read section 12 of the CPU 1 reads out opening degrees $S_{01}$ to $S_{0n}$ (initial values) of the respective ink fountain keys 11 (step S103). In this embodiment, a known image area measuring apparatus disclosed in, e.g., Japanese Patent Laid-Open No. 58-201008 is used to measure the image areas of the zones obtained by dividing the plate surface. The opening degrees $S_{01}$ to $S_{0n}$ of the ink fountain keys 11 corresponding to the zones are obtained as values corresponding to the measurement values, respectively. The resultant opening degrees are stored as the initial values of the ink fountain keys 11 in the magnetic card 8.

The CPU 1 presets the initial values $S_{01}$ to $S_{0n}$ read out from the card 8 as set values $S_{b1}$ to $S_{bn}$ (Step S104), and the current printing speed $V_x$ is detected from the rotational frequency detector 7 through the ink fountain key opening degree controller 10. After the detected printing speed $V_x$ is confirmed not to be equal to the previous printing speed $V_{x-1}$ ($V_x \neq V_{x-1}$) (step S106), current opening degrees $S_1$ to $S_n$ (current values) of the ink fountain keys 11 are detected (step S107). The current values $S_1$ to $S_n$ are input from the ink fountain key opening degree detectors 3 to the CPU 1 through the ink fountain key opening degree controller 10.

The CPU 1 compares the current values $S_1$ to $S_n$ from the ink fountain key opening degree detectors 3 with the set values $S_{b1}$ to $S_{bn}$ (step S108). The current values $S_1$ to $S_n$ are assumed to be converged to the initial values $S_{01}$ to $S_{0n}$ by control prior to printing. That is, in step S108, $S_1$ to $S_n = S_{b1}$ to $S_{bn}$, so that the correction amount setting section 13 of the CPU 1 executes processing in step S109.

In step S109, from the characteristic table I, the ink fountain key ratio read section 13*b* of the correction amount setting portion 13 obtains the ink fountain ratio setting value $\alpha_{(vx)}$ corresponding to the printing speed $V_x$ obtained in step S105. From the characteristic table II, the addition ratio read section 13*a* obtains addition ratios $\beta_{(S01)}$ to $\beta_{(S0n)}$ corresponding to the initial values $S_{01}$ to $S_{0n}$ read out in step S103. At this time, the ink fountain ratio read section 13*b* and the addition ratio read section 13*a* select and refer to the characteristic tables I and II having patterns corresponding to the paper quality and the kind of ink set by the switches 5. The correction amount calculating section 13*c* and the correction value setting section 14 substitute the resultant ink fountain ratio setting value $\alpha_{(Vx)}$ and the resultant addition ratios $\beta_{(S01)}$ to $\beta_{(S0n)}$ into equations (1–1) to (1–n) below to obtain correction opening degrees (correction values) $S_1'$ to $S_n'$ of the ink fountain keys 11. That is, the correction amount calculating section 13*c* multiplies the ink fountain key ratio setting value $\alpha_{(Vx)}$ with the addition ratios $\beta_{(S01)}$ to $\beta_{(S0n)}$ to obtain correction amounts $\Delta S_1$ to $\Delta S_n$. The correction value setting section 14 adds the correction amounts $\Delta S_1$ to $\Delta S_n$ to the initial values $S_{01}$ to $S_{0n}$ to obtain the correction values $S_1'$ to $S_n'$.

$$S_1' = S_{01} + \alpha_{(Vx)} \cdot [\beta_{(S01)}/100] \quad (1\text{-}1)$$
$$S_2' = S_{02} + \alpha_{(Vx)} \cdot [\beta_{(S02)}/100] \quad (1\text{-}2)$$
$$\vdots$$
$$S_n' = S_{0n} + \alpha_{(Vx)} \cdot [\beta_{(S0n)}/100] \quad (1\text{-}n)$$

The CPU 1 then presets the resultant correction values $S_1'$ to $S_n'$ (step S110) to converge the current values $S_1$ to $S_n$ to the correction values $S_1'$ to $S_n'$. The correction values $S_1'$ to $S_n'$ are given as the set values $S_{b1}$ to $S_{bn}$ (step S111), the current printing speed $V_x$ is given as the previous printing speed $V_{x-1}$ (step S112), and the printing speed $V_x$ is then detected again (step S105). The currently detected printing speed $V_x$ is compared with the previous printing speed $V_{x-1}$ (step S106). If no change is detected, the flow returns to step S112. However, if any change is detected, i.e., if $V_x \neq V_{x-1}$, then the current values $S_1$ to $S_n$ are read out (step S107). These current values $S_1$ to $S_n$ are compared with the set values $S_{b1}$ to $S_{bn}$ obtained in step S111 (step S108).

At this time, the current values $S_1$ to $S_n$ have been converged to the correction values $S_1'$ to $S_n'$ in step S110 described above. For this reason, in step S108, $S_1$ to $S_n = S_{b1}$ to $S_{bn}$ is established. In step S109, the CPU 1 obtains the ink fountain ratio setting value $\alpha_{(Vx)}$ from the characteristic table I in accordance with the changed printing speed $V_x$ and multiplies this ink fountain ratio setting value $\alpha_{(Vx)}$ with the addition ratios $\beta_{(S01)}$ to $\beta_{(S0n)}$ to obtain the correction values $\Delta S_1$ to $\Delta S_n$. These correction values $\Delta S_1$ to $\Delta S_n$ are added to the initial values $S_{01}$ to $S_{0n}$ to obtain the correction values $S_1'$ to $S_n'$. In step S110, the correction values $S_1'$ to $S_n'$ are set to converge the current values $S_1$ to $S_n$ to the set correction values $S_1'$ to $S_n'$. In step S111, the converged correction values $S_1'$ to $S_n'$ are given as the set values $S_{b1}$ to $S_{bn}$, and the flow returns to step S112. In this embodiment, as described above, the correction values $S_1'$ to $S_n'$ are obtained in accordance with a change in printing speed $V_x$, and the current values $S_1$ to $S_n$ are controlled to coincide with these correction values $S_1'$ to $S_n'$.

More specifically, the ink fountain key opening degree controller 10 controls to drive the ink fountain key motors 2 to cause the current values $S_1$ to $S_n$ to coincide with the correction values $S_1'$ to $S_n'$ obtained by the CPU 1, thereby changing the opening degrees of the ink fountain keys 11. Therefore, adjustment is performed to keep the ink supply amount constant regardless of a change in printing speed.

The correction amounts $\Delta S_1$ to $\Delta S_n$ for obtaining the correction values $S_1'$ to $S_n'$ are obtained as values for keeping the ink supply amount constant in accordance with the settings of the characteristic tables I and II regardless of a change in printing speed $V_x$. More specifically, according to this embodiment, the ink fountain ratio setting value $\alpha$ is set to be appropriately increased stepwise with an increase in printing speed $V_x$, and the addition ratio $\beta$ is set to be appropriately decreased stepwise with an increase in initial value $S_0$. Therefore, the correction amounts $\Delta S_1$ to $\Delta S_n$ for keeping the ink supply amount constant regardless of a change in printing speed $V_x$ are obtained. Even if the printing speed $V_x$ increases, the printing density can be stabilized. The color registration time can be shortened, the number of waste paper sheets can be reduced, and problems such as degradation of durability of mechanical components and overload on electrical components can be solved.

Note that processing in step S113 is performed, and the flow advances to step S109 when $S_1$ to $S_n$=$S_{b1}$ to $S_{bn}$ is not established in step S108 upon fine adjustment or the like by a manual operation with the switches 5. In step S113, an ink fountain ratio setting value $\alpha_{(Vx-1)}$ corresponding to the previous printing speed $V_{x-1}$ is obtained from the characteristic table I, and addition ratios $\beta_{(S01)}$ to $\beta_{(S0n)}$ corresponding to the initial values $S_{01}$ to $S_{0n}$ are obtained from the characteristic table II. The resultant values $\alpha_{(Vx-1)}$ and $\beta_{(S01)}$ to $\beta_{(S0n)}$ are substituted into equations (2–1) to (2–n) below to reversely obtain new initial values $S_{01}$ to $S_{0n}$ upon addition of the fine adjustment components to the current initial values.

$$S_{01} = S_1 - \alpha_{(Vx-1)} \cdot [\beta_{(S01)}/100] \quad (2\text{-}1)$$
$$S_{02} = S_2 - \alpha_{(Vx-1)} \cdot [\beta_{(S02)}/100] \quad (2\text{-}2)$$
$$\vdots$$
$$S_{0n} = S_n - \alpha_{(Vx-1)} \cdot [\beta_{(S0n)}/100] \quad (2\text{-}n)$$

This embodiment has exemplified an application to a rotary printing press. Rotary printing presses include a web-fed printing press and a sheet-fed printing press. In a sheet-fed printing press, the density tends to increase at a high speed. For this reason, characteristic tables I and II are formed to restrict the ink fountain keys at a higher speed and can sufficiently cope with control for the sheet-fed printing press. In this case, the type of printing press may be designated with the switches 5 to selectively read out a corresponding characteristic table. In perfection printing, characteristic tables I and II may be set at the upper and lower portions of each printing unit.

In this embodiment, ink fountain key opening degrees obtained in accordance with the image areas of the respective areas, which are measured as the initial values $S_{01}$ to $S_{0n}$, are used and corrected. However, the image areas of the respective zones, which are measured as the initial values $S_{01}$ to $S_{0n}$, may be used and corrected. Finally, ink fountain key opening degrees may be obtained in accordance with the corrected image areas of the respective zones, and the ink fountain keys may be controlled in accordance with the resultant ink fountain key opening degrees to obtain the same effect as described above.

The ink fountain key ratio setting value $\alpha$ and the addition ratio $\beta$ are read out from the characteristic tables in the above embodiment. However, the ink fountain key ratio setting value and the addition ratio may be obtained by calculation formulas. In addition, the magnetic card 8 and the magnetic disk 9 may be constituted by a common magnetic medium. In addition, the ink fountain key opening degree controller 10 may be constituted by the CPU 1.

As can be apparent from the above description, in the method and apparatus for controlling an ink supply amount, the correction amounts $\Delta S_1$ to $\Delta S_n$ for keeping the ink supply amount constant regardless of a change in printing speed $V_x$ are obtained. In addition, when characteristic tables are appropriately set, the printing density can be stabilized even at a higher printing speed. Moreover, the color registration time can be shortened, the number of waste paper sheets can be reduced, and problems such as degradation of durability of mechanical components and overload on electrical components can be solved.

What is claimed is:

1. A method of controlling an ink supply amount for a printing press, comprising the steps of:

reading out, as initial values, values corresponding to image areas of a plurality of zones obtained by dividing a plate surface;

obtaining correction amounts on the basis of the readout initial values and a current printing speed, wherein the step of obtaining correction amounts further comprises the steps of:

preparing a first characteristic table representing a relationship between the printing speed and ink fountain ratio setting values;

preparing a second characteristic table representing a relationship between an ink fountain key opening degree and addition ratios;

reading out addition ratios corresponding to the readout initial values from said second table;

reading out an ink fountain key ratio setting value corresponding to a current printing speed from said first table; and multiplying the addition ratios read out from said second table with the ink fountain ratio setting value read out from said first table to obtain the correction amounts;

correcting the initial values using the obtained correction amounts to obtain correction values; and on the basis of the obtained correction values, controlling opening degrees of a plurality of ink fountain keys for adjusting ink supply amounts of the zones.

2. A method according to claim 1, wherein the step of reading out, as initial values, values corresponding to image areas comprises the step of reading out the values corresponding to the image areas of the zone as initial values of the opening degrees of the ink fountain keys for the respective zones, and the step of correcting the initial values using the obtained correction amounts to obtain correction values comprises the step of adding the correction amounts to the initial values to obtain the correction values.

3. An apparatus for controlling an ink supply amount for a printing press, comprising:

first read means for reading out, as initial values, values corresponding to image areas of a plurality of zones obtained by dividing a plate surface;

correction amount setting means for obtaining correction amounts on the basis of the readout initial values from said first read means and a current printing speed, said correction amount setting means further comprising:

first storage means for storing a first characteristic table representing a relationship between the printing speed and ink fountain ration setting values;

second storage means for storing a second characteristic table representing a relationship between an ink fountain key opening degree and addition ratios;

second read means for reading out addition ratios corresponding to the readout initial values from said second table in said second storage means;

third read means for reading out an ink fountain key ratio setting value corresponding to a current printing speed from said first table in said first storage means; and correction amount calculating means for multiplying the addition ratios read out from said second table with the ink fountain ratio setting value read out from said first table to obtain the correction amounts;

correction value setting means for correcting the initial values from said first read means using the obtained correction amounts from said correction amount setting means to obtain correction values; and control means for, on the basis of the obtained correction values from said correction value setting means, controlling opening degrees of a plurality of ink fountain keys for adjusting ink supply amounts of the zones.

4. An apparatus according to claim 3, further comprising switch means for independently setting paper quality and a kind of ink, and wherein said second and first storage means store said second and first tables each storing a plurality of patterns, and said second and third read means refer to said second and first tables having patterns selected from the plurality of patterns on the basis of settings of said switch means to read out an addition ratio and an ink fountain ratio setting value.

5. An apparatus according to claim 3, wherein said first read means reads out the values corresponding to the image areas of the zone as initial values of the opening degrees of the ink fountain keys for the respective zones, and said correction value setting means adds the correction amounts from said correction amount setting means to the initial values from said first read means to obtain the correction values.

* * * * *